US005880676A

United States Patent [19]

Tsou

[11] Patent Number: 5,880,676

[45] Date of Patent: Mar. 9, 1999

[54] CHRISTMAS TREE ORNAMENT-SHAPED FIRE ALARM

[76] Inventor: Peiki F. Tsou, 25959 Bay Ave., Moreno Valley, Calif. 92553-4837

[21] Appl. No.: 871,254

[22] Filed: Jun. 9, 1997

[51] Int. Cl.[6] ..... G08B 17/10

[52] U.S. Cl. ..... 340/628; 340/629; 340/693.2; 340/693.6; 340/539

[58] Field of Search ..... 340/628, 693.2, 340/620, 629, 539, 693.6

[56] References Cited

U.S. PATENT DOCUMENTS

| | | | |
|---|---|---|---|
| D. 329,393 | 9/1992 | Hawkins, III | D10/106 |
| D. 354,015 | 1/1995 | Sims et al. | D10/106 |
| 3,806,921 | 4/1974 | Pappas | 340/412 |
| 4,075,614 | 2/1978 | White | 340/227.1 |
| 4,623,878 | 11/1986 | Schoenwetter | 340/628 |
| 4,914,425 | 4/1990 | Kaminaka et al. | 340/693 |
| 4,954,816 | 9/1990 | Mattison | 340/693 |
| 5,160,916 | 11/1992 | Ishii et al. | 340/629 |
| 5,396,221 | 3/1995 | Bridges | 340/628 |
| 5,625,345 | 4/1997 | Starks et al. | 340/628 |
| 5,642,099 | 6/1997 | Nagashima | 340/630 |

*Primary Examiner*—Daniel J. Wu
*Assistant Examiner*—Toan N. Pham

[57] ABSTRACT

A Christmas tree ornament-shaped fire alarm is provided including a housing shaped as a Christmas ornament and having an interior space. The housing is adapted to be situated on a Christmas tree. Further provided is a fire alarm situated within the housing for providing an indication to a user upon the detection of the Christmas tree being on fire.

5 Claims, 2 Drawing Sheets

CHRISTMAS TREE ORNAMENT-SHAPED FIRE ALARM

BACKGROUND OF THE INVENTION

1. Field of the Invention

The present invention relates to a Christmas tree ornament-shaped fire alarm and more particularly pertains to disguising a fire alarm as a tree ornament.

2. Description of the Prior Art

The use of fire alarms is known in the prior art. More specifically, fire alarms heretofore devised and utilized for the purpose of indicating the presence of a fire are known to consist basically of familiar, expected and obvious structural configurations, notwithstanding the myriad of designs encompassed by the crowded prior art which have been developed for the fulfillment of countless objectives and requirements.

In this respect, the Christmas tree ornament-shaped fire alarm according to the present invention substantially departs from the conventional concepts and designs of the prior art, and in so doing provides an apparatus primarily developed for the purpose of disguising a fire alarm as a tree ornament.

Therefore, it can be appreciated that there exists a continuing need for a new and improved Christmas tree ornament-shaped fire alarm which can be used for disguising a fire alarm as a tree ornament. In this regard, the present invention substantially fulfills this need.

SUMMARY OF THE INVENTION

In view of the foregoing disadvantages inherent in the known types of fire alarms now present in the prior art, the present invention provides an improved Christmas tree ornament-shaped fire alarm. As such, the general purpose of the present invention, which will be described subsequently in greater detail, is to provide a new and improved Christmas tree ornament-shaped fire alarm which has all the advantages of the prior art and none of the disadvantages.

To attain this, the present invention essentially comprises a housing having a spherical configuration with an interior space and an exterior surface. Note FIGS. 1 & 2. The housing includes a plurality of decorative cutouts symmetrically formed in the exterior surface. A mesh material is situated over the cut outs for providing a plurality of vents. The housing further has an inverted hook-shaped hanger coupled to a top thereof for allowing the housing to be hung on a limb of a Christmas tree. With reference now to FIG. 3, it can be seen that further provided is a first audible alarm means. The first audible alarm means is positioned within the interior space of the housing. In use, the first audible alarm means is adapted to emit an audible alarm upon the receipt of an activation signal. Further positioned within the interior space of the housing is transmitter means. The transmitter means is connected to a short linear antenna which is coupled to the top of the housing and extended upwardly therefrom. In operation, the transmitter means is adapted transmit a radio actuation signal having a predetermined frequency via free space upon the receipt of the activation signal. Also included is a smoke sensor means which is also positioned within the interior space of the housing adjacent the vents. The smoke sensor means is adapted for transmitting the activation signal when smoke is detected through the vents of the housing. Associated therewith is heat sensor means. Similar to the smoke sensor means, the heat sensor means is positioned within the interior space of the housing. The heat sensor means is designed for transmitting the activation signal when a temperature greater that a predetermined degree is detected through the vents of the housing. As can be seen in FIGS. 1–3, a test button is provided having an O-shaped configuration. The test button is situated about the antenna on the top of the housing and is adapted to transmit the activation signal upon the depression thereof. As shown in FIG. 3, transmitter control means is positioned within the interior space of the housing. Such control means is connected between the first audible alarm means, transmitter means, smoke sensor means, heat sensor means, and test button. The transmitter control means is adapted to allow the transfer of the activation signal to the first audible alarm and the transmitter means upon at least one of the smoke sensor, heat sensor means and test button transmitting the activation signal. The last component positioned within the interior space of the housing is first low battery detection means. The first low battery detection means is adapted for indicating that a battery situated within the housing for powering purposes is providing power below a predetermined amount. Also shown in FIGS. 1 & 2 is a portable receiver unit having a rectangular configuration and an interior space. Situated within the interior space of the receiver unit is a receiver means which is connected to an antenna. The receiver means is capable of transmitting the activation signal upon the receipt of the radio actuation signal via free space. Also positioned within the interior space of the receiver unit is second audible alarm means. The second audible alarm means is adapted to emit an audible alarm upon the receipt of an activation signal. Associated with the previous alarm means is visual alarm means. The visual alarm mens is also positioned within the interior space of the receiver unit. The visual alarm means has a light situated on a front face of the receiver unit for intermittently emitting light upon the receipt of an activation signal. The receiver unit is also equipped with a test button. Such button is situated on the front face of the receiver unit for transmitting the activation signal upon the depression thereof. Receiver control means is positioned within the interior space of the receiver unit and connected between the second audible alarm means, receiver means, visual alarm means, and test button. The receiver control means is adapted to allow the transfer of the activation signal to the second audible alarm means and the visual alarm means when at least one of the receiver means and test button transmits the activation signal. Lastly, second low battery detection means is positioned within the interior space of the receiver unit for indicating that a battery situated within the receiver unit for powering purposes is providing power below a predetermined amount.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Christmas tree ornament-shaped fire alarm which has all the advantages of the prior art fire alarms and none of the disadvantages.

It is another object of the present invention to provide a new and improved Christmas tree ornament-shaped fire alarm which may be easily and efficiently manufactured and marketed.

It is a further object of the present invention to provide a new and improved Christmas tree ornament-shaped fire alarm which is of a durable and reliable construction.

An even further object of the present invention is to provide a new and improved Christmas tree ornament-shaped fire alarm which is susceptible of a low cost of manufacture with regard to both materials and labor, and which accordingly is then susceptible of low prices of sale to the consuming public, thereby making such Christmas tree ornament-shaped fire alarm economically available to the buying public.

Still yet another object of the present invention is to provide a new and improved Christmas tree ornament-shaped fire alarm which provides in the apparatuses and methods of the prior art some of the advantages thereof, while simultaneously overcoming some of the disadvantages normally associated therewith.

Still another object of the present invention is to disguise a fire alarm as a tree ornament.

Lastly, it is an object of the present invention to provide a new and improved Christmas tree ornament-shaped fire alarm is provided including a housing shaped as a Christmas ornament and having an interior space. The housing is adapted to be situated on a Christmas tree. Further provided is a fire alarm situated within the housing for providing an indication to a user upon the detection of the Christmas tree being on fire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
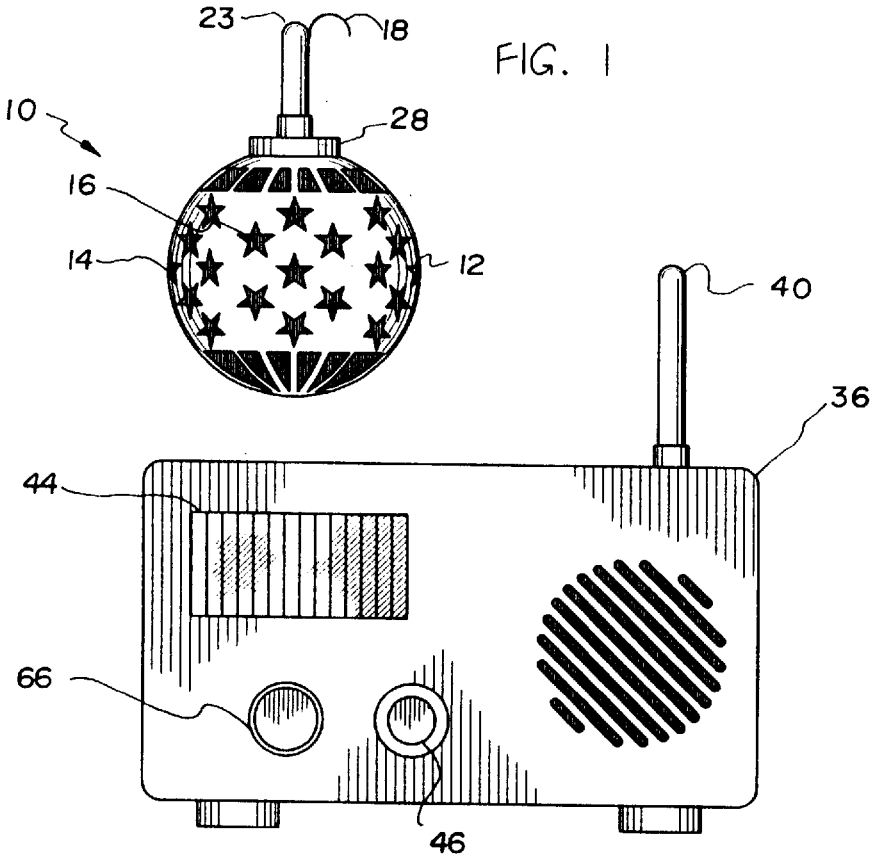
FIG. 1 is a perspective illustration of the preferred embodiment of the Christmas tree ornament-shaped fire alarm constructed in accordance with the principles of the present invention.

With reference now to the drawings, and in particular to FIG. 1 thereof, a new and improved Christmas tree ornament-shaped fire alarm embodying the principles and concepts of the present invention and generally designated by the reference numeral 10 will be described.

The present invention, the new and improved Christmas tree ornament-shaped fire alarm, is comprised of a plurality of components. Such components in their broadest context include a housing, heat sensor means, smoke sensor means, visual and audio alarm means, lower battery detection means, and transmitter and receiver means. Such components are individually configured and correlated with respect to each other so as to attain the desired objective.

More specifically, it will be noted that system 10 of the present invention includes an ornament housing 12 having a spherical configuration with an interior space and an exterior surface. Note FIGS. 1 & 2. The housing includes a plurality of decorative cutouts 14 symmetrically formed in the exterior surface. In the preferred embodiment, such cutouts are shaped like stars and triangles. A mesh material 16 is situated over the cut outs for providing a plurality of vents. The housing further has an inverted hook-shaped hanger 18 coupled to a top thereof for allowing the housing to be hung on a limb of an unillustrated Christmas tree.

Figure 3:
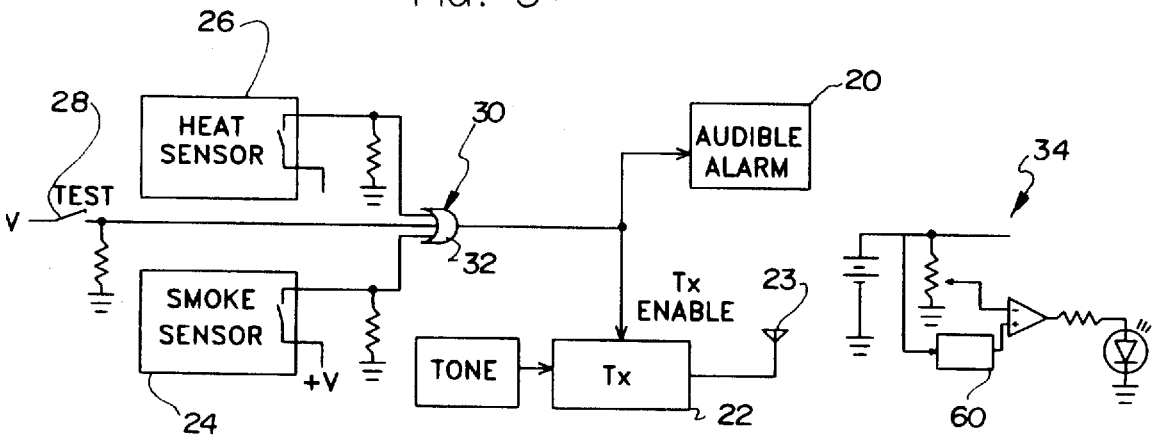
FIG. 3 is a schematic diagram of the electric circuitry of the ornament housing which is adapted to carry out the function thereof.

With reference now to FIG. 3, it can be seen that further provided is a first audible alarm means 20. The first audible alarm means is positioned within the interior space of the ornament housing. In use, the first audible alarm means is adapted to emit an audible alarm upon the receipt of an activation signal.

Further positioned within the interior space of the housing is transmitter means 22. The transmitter means is connected to a short linear antenna 23 which is coupled to the top of the housing and extended upwardly therefrom. In operation, the transmitter means is adapted transmit a radio actuation signal having a predetermined frequency via free space upon the receipt of the activation signal.

Also included is a smoke sensor means 24 which is also positioned within the interior space of the housing adjacent the vents. The smoke sensor means is adapted for transmitting the activation signal when smoke is detected through the vents of the housing. Associated therewith is heat sensor means 26. Similar to the smoke sensor means, the heat sensor means is positioned within the interior space of the housing. The heat sensor means is designed for transmitting the activation signal when a temperature greater that a predetermined degree is detected through the vents of the housing.

Figure 2:
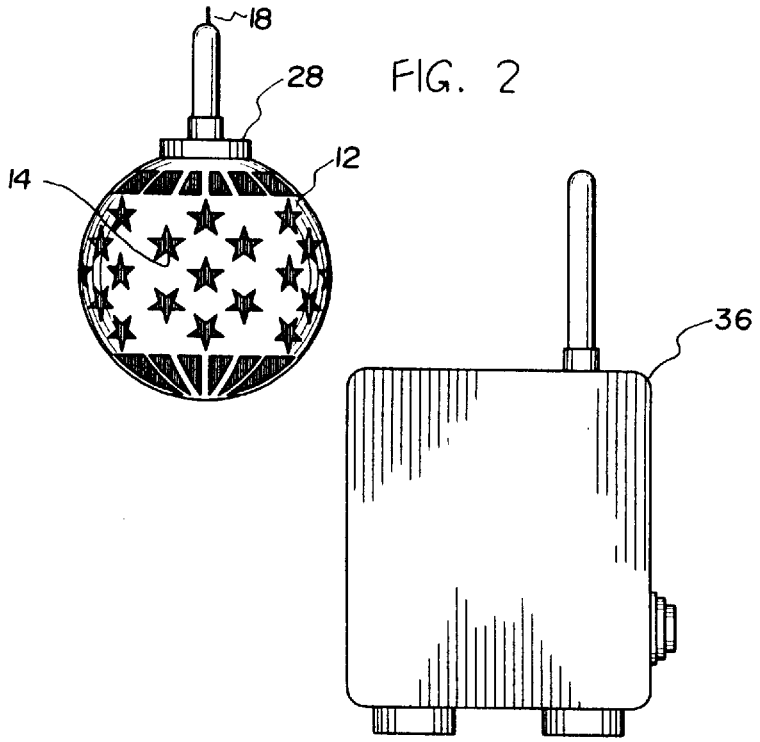
FIG. 2 is a side view of both the ornament housing and receiver unit.

As can be seen in FIGS. 1–3, a test button 28 is provided having an O-shaped configuration. The test button is situated about the antenna on the top of the housing and is adapted to transmit the activation signal upon the depression thereof.

As shown in FIG. 3, transmitter control means 30 is positioned within the interior space of the housing. Such control means is connected between the first audible alarm means, transmitter means, smoke sensor means, heat sensor means, and test button. The transmitter control means is adapted to allow the transfer of the activation signal to the first audible alarm and the transmitter means upon at least one of the smoke sensor, heat sensor means and test button transmitting the same. To accomplish this, the transmitter control means preferably comprises a 3-input OR gate 32.

The last component positioned within the interior space of the ornament housing is first low battery detection means 34. The first low battery detection means is adapted for indicating that a battery situated within the housing for powering purposes is providing power below a predetermined amount. Further details regarding the first low battery detection means will be provided hereinafter.

Also shown in FIGS. 1 & 2 is a portable receiver unit 36 having a rectangular configuration and an interior space. Situated within the interior space of the receiver unit is a receiver means 38 which is connected to an antenna 40. The receiver means is capable of transmitting the activation signal upon the receipt of the radio actuation signal via free space.

Also positioned within the interior space of the receiver unit is second audible alarm means 42. Both of the audible alarm means preferably comprise a peizo-electric buzzer. Similar to the first audible alarm means, the second audible alarm means is adapted to emit an audible alarm upon the receipt of the activation signal.

Associated with the previous alarm means is visual alarm means 44. The visual alarm mens is also positioned within the interior space of the receiver unit. The visual alarm means has a light situated on a front face of the receiver unit for intermittently emitting light upon the receipt of the activation signal. Ideally, the light is a high-intensity strobe light.

The receiver unit is also equipped with a test button 46. Such button is situated on the front face of the receiver unit for transmitting the activation signal upon the depression thereof. It should be noted that the test button 28 of the ornament housing is adapted to test all of the components of the present invention while the test button 46 of the receiver unit is utilized only for testing the components of the receiver unit.

Receiver control means 48 is positioned within the interior space of the receiver unit and connected between the second audible alarm means, receiver means, visual alarm means, and test button. The receiver control means is adapted to allow the transfer of the activation signal to the second audible alarm means and the visual alarm means when at least one of the receiver means and test button transmits the activation signal. To accomplish such, the receiver control means ideally comprises a 2-input OR gate 50.

Lastly, second low battery detection means 56 is positioned within the interior space of the receiver unit for indicating that a battery situated within the receiver unit for powering purposes is providing power below a predetermined amount.

Figure 4:
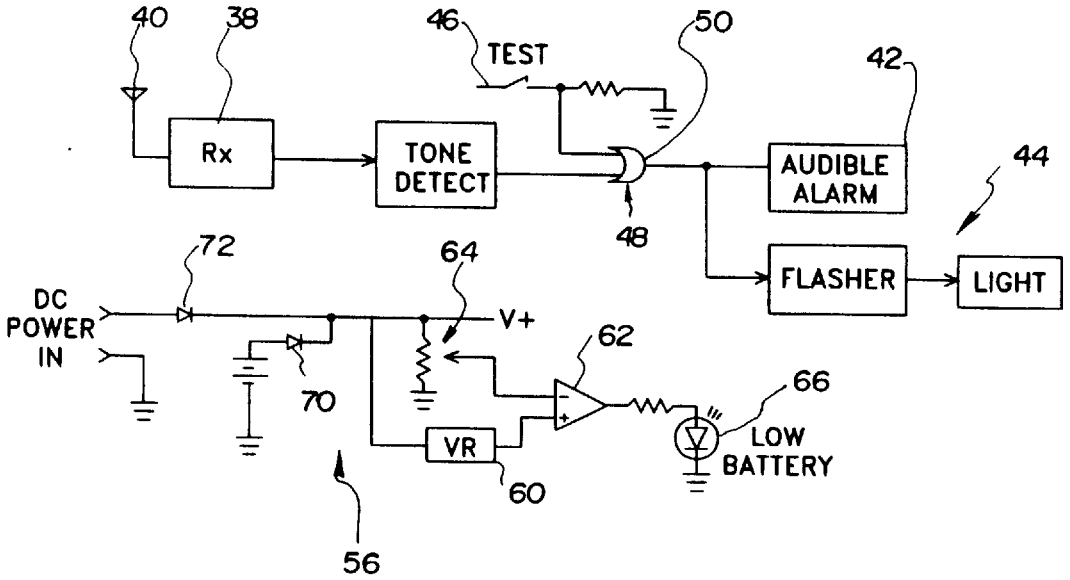
FIG. 4 is a schematic diagram of the electric circuitry of the receiver unit.

As shown in FIGS. 3 & 4, both low battery detection means include a plurality of similar components. Both are equipped with a voltage regulator 60 coupled between the portable battery and a positive input of an operational amplifier 62. Further a provided is a voltage divider 64 connected between the battery and a negative input of the operational amplifier. By this design, an output of the op-amp goes high upon the battery power falling below a predetermined level as governed by the voltage regulator. A LED 66 is connected to the output of the OP-AMP for signaling upon detection of a low battery. In the case of the low battery detection means of the ornamental housing, the LED thereof is located adjacent one of the vents thereof such that the light emitted therefrom can be seen. Further, in the case of the low battery detection means of the receiver unit, a diode 70 is connected between the battery and the voltage regulator. Further another diode 72 is connected between a DC adapter input 76 and the voltage regulator. Such diodes permit the battery to provide power in the case that the power received from the DC adapter ceases. As shown in FIG. 1, the LED of the receiver unit is positioned adjacent the test button thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those-skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved Christmas tree ornament-shaped fire alarm comprising, in combination:

a housing having a spherical configuration with an interior space and an exterior surface, the housing having a plurality of decorative cutouts symmetrically formed in the exterior surface with a mesh material situated thereon for providing a plurality of vents, the housing further having a hook-shaped hanger coupled to a top thereof for allowing the housing to be hung on a limb of a Christmas tree;

first audible alarm means positioned within the interior space of the housing and adapted to emit an audible alarm upon the receipt of an activation signal;

transmitter means positioned within the interior space of the housing and connected to a short linear antenna, the antenna coupled to the top of the housing and extended upwardly therefrom, the transmitter means adapted transmit a radio actuation signal having a predetermined frequency via free space upon the receipt of the activation signal;

smoke sensor means positioned within the interior space of the housing for transmitting the activation signal when smoke is detected through the vents of the housing;

heat sensor means positioned within the interior space of the housing for transmitting the activation signal when a temperature greater that a predetermined degree is detected through the vents of the housing;

a test button having an O-shaped configuration, the test button situated about the antenna on the top of the housing and adapted to transmit the activation signal upon the depression thereof;

transmitter control means positioned within the interior space of the housing and connected between the first audible alarm means, transmitter means, smoke sensor means, heat sensor means, and test button, the transmitter control means adapted to allow the transfer of the activation signal to the first audible alarm and the transmitter means upon at least one of the smoke sensor, heat sensor means and test button transmitting the activation signal;

first low battery detection means positioned within the interior space of the housing for indicating that a battery situated within the housing for powering purposes is providing power below a predetermined amount;

a portable receiver unit having a rectangular configuration and an interior space;

receiver means situated within the interior space of the receiver unit and connected to an antenna, the receiver means adapted for transmitting the activation signal upon the receipt of the radio actuation signal via free space;

second audible alarm means positioned within the interior space of the receiver unit and adapted to emit an audible alarm upon the receipt of the activation signal;

visual alarm means positioned within the interior space of the receiver unit, the visual alarm means having a light situated on a front face of the receiver unit for intermittently emitting light upon the receipt of the activation signal;

a test button situated on the front face of the receiver unit for transmitting the activation signal upon the depression thereof;

receiver control means positioned within the interior space of the receiver unit and connected between the second audible alarm means, receiver means, visual alarm means, and test button, the receiver control means adapted to allow the transfer of the activation signal to the second audible alarm means and the visual alarm means when at least one of the receiver means and test button transmits the activation signal; and second low battery detection means positioned within the interior space of the receiver unit for indicating that a battery situated within the receiver unit for powering purposes is providing power below a predetermined amount.

2. A Christmas tree ornament-shaped fire alarm comprising:

a housing shaped as a Christmas ornament and having an interior space, the housing adapted to be situated on a Christmas tree;

fire alarm means situated within the interior space of the housing for providing an indication to a user upon the detection of the Christmas tree being on fire;

wherein the housing has a plurality of vents formed therein with a mesh material formed thereover;

transmitter means positioned within the interior space of the housing;

smoke sensor means positioned within the interior space of the housing;

heat sensor means positioned within the interior space of the housing;

a test button;

transmitter control means positioned within the interior space of the housing;

first low battery detection means positioned within the interior space of the housing;

a portable receiver unit;

receiver means situated within the interior space of the receiver unit;

second audible alarm means positioned within the interior space of the receiver unit;

visual alarm means positioned within the interior space of the receiver unit;

receiver control means positioned within the interior space of the receiver unit; and second low battery detection means positioned within the interior space of the receiver unit.

3. A Christmas tree ornament-shaped fire alarm as set forth in claim 2 wherein the audible alarm means positioned within the interior space of the housing is adapted to emit an audible alarm upon the detection of the Christmas tree being on fire.

4. A Christmas tree ornament-shaped fire alarm as set forth in claim 2 wherein the transmitter means positioned within the interior space of the housing is for transmitting a radio actuation signal having a predetermined frequency via free space upon the detection of the Christmas tree being on fire, the receiver means adapted for providing an alarm upon the receipt of the radio actuation signal via free space.

5. A Christmas tree ornament-shaped fire alarm as set forth in claim 2 wherein the low battery detection means positioned within the interior space of the housing is for indicating that a battery situated within the housing for powering purposes is providing power below a predetermined amount.

* * * * *